US008565664B2

(12) United States Patent
Yamauchi et al.

(10) Patent No.: US 8,565,664 B2
(45) Date of Patent: Oct. 22, 2013

(54) IMAGE FORMING APPARATUS

(75) Inventors: Kazumichi Yamauchi, Hachioji (JP); Hideki Nakamura, Hachioji (JP); Akira Okamoto, Hino (JP); Kazutoshi Yoshimura, Hachioji (JP); Masatoshi Ogawa, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 496 days.

(21) Appl. No.: 12/813,714

(22) Filed: Jun. 11, 2010

(65) Prior Publication Data

US 2010/0322642 A1 Dec. 23, 2010

(30) Foreign Application Priority Data

Jun. 18, 2009 (JP) ..... JP2009-145003
Apr. 15, 2010 (JP) ..... JP2010-093675

(51) Int. Cl.
*G03G 15/00* (2006.01)
*B65H 1/00* (2006.01)
*B65H 11/00* (2006.01)

(52) U.S. Cl.
USPC ..... 399/393; 399/23; 399/391; 271/8.1; 271/9.01

(58) Field of Classification Search
USPC ..... 399/393, 23
See application file for complete search history.

(56) References Cited

U.S. PATENT DOCUMENTS 4,131,274 A * 12/1978 Sue ..... 271/9.11
4,503,960 A * 3/1985 Koeleman et al. ..... 192/127
5,069,434 A * 12/1991 Sellers ..... 271/2
5,732,307 A * 3/1998 Yoshizuka et al. ..... 399/23
5,839,015 A * 11/1998 Faguy et al. ..... 399/23
5,882,005 A * 3/1999 Araseki et al. ..... 271/126
6,246,466 B1 * 6/2001 Hirano et al. ..... 355/407
6,957,025 B1 * 10/2005 Sinn et al. ..... 399/84
7,177,554 B2 * 2/2007 Van Vliembergen ..... 399/23
7,542,687 B2 * 6/2009 Ai ..... 399/23

(Continued)

FOREIGN PATENT DOCUMENTS

JP 63057455 A * 3/1988
JP 02103567 A * 4/1990

(Continued)

OTHER PUBLICATIONS

Official Translation of JP 63057455 A, FLS Inc., Sep. 2012.*

(Continued)

*Primary Examiner* — Matthew G Marini
*Assistant Examiner* — Nguyen Q Ha
(74) *Attorney, Agent, or Firm* — Holtz, Holtz, Goodman & Chick, PC

(57) ABSTRACT

An image forming apparatus provided with a sheet feeding tray to store sheets for image forming; a sheet feeding section to feed the sheets form the sheet feeding tray so as to supply the sheets for the image forming; and a control section to individually administer remaining sheets stored in the sheet feeding tray in advance and replenishment sheets replenished when the sheet feeding tray is replenished with the sheets in a state where the sheets stored in the sheet feeding tray in advance is remaining. Whereby, a JOB can be continued or aborted appropriately with reference to information and remaining amounts of remaining sheets and replenishment sheets in one sheet feeding tray, since the information and the remaining amounts are administered individually.

20 Claims, 9 Drawing Sheets

(56) References Cited

U.S. PATENT DOCUMENTS

| | | | | |
|---|---|---|---|---|
| 7,643,762 | B2 * | 1/2010 | Eto | 399/23 |
| 2007/0201923 | A1 * | 8/2007 | Asada et al. | 399/405 |
| 2008/0296827 | A1 * | 12/2008 | Chino | 271/9.06 |
| 2009/0317097 | A1 * | 12/2009 | Shiraki et al. | 399/23 |

FOREIGN PATENT DOCUMENTS

| | | | | |
|---|---|---|---|---|
| JP | 05246571 | A | * | 9/1993 |
| JP | 10-324436 | A | | 12/1998 |
| JP | 11-349150 | A | | 12/1999 |
| JP | 2002002974 | A | * | 1/2002 |
| JP | 2002-278377 | A | | 9/2002 |
| JP | 2008249840 | A | * | 10/2008 |

OTHER PUBLICATIONS

Chinese Office Action dated Jun. 5, 2013 (and English translation thereof) in counterpart Chinese Application No. 201010205925.1.

* cited by examiner

IMAGE FORMING APPARATUS

This application is based on Japanese Patent Application No. 2010-093675 filed on Apr. 15, 2010, in Japanese Patent Office, the entire content of which is hereby incorporated by reference.

BACKGROUND OF THE INVENTION

The present invention relates to an image forming apparatus wherein a sheet stored in a sheet feeding tray is fed for image forming.

TECHNICAL FIELD

In an image forming apparatus to transfer an image on a sheet based on image data, the sheets stored in the sheet feeding tray are fed subsequently to form the image. In the image forming apparatus, usually a plurality of the sheet feeding trays are provided and sheet information and an amount of the remaining sheet for each sheet tray is administered and displayed on the display section (Patent Documents 1 to 3: Unexamined Japanese Patent Application Publication Nos. H10-324436, H11-349150 and 2002-278377). For example, in Patent Document 1, there is suggested a sheet feeding apparatus intended that number of remaining sheets stacked in the sheet tray is detected in real time with a high accuracy. Also, in Patent Document 2, there is disclosed an apparatus which enables to identify a kind of the sheet stored in the sheet tray and to detect a state of sheet changing. In Patent Document 3, an apparatus realizing setting, changing and displaying information of the sheet in the sheet tray is described.

Patent Document 1: Unexamined Japanese Patent Application Publication No. H10-324436

Patent Document 2: Unexamined Japanese Patent Application Publication No. H11-349150

Patent Document 3: Unexamined Japanese Patent Application Publication No. 2002-278377

Incidentally, in case a kind of sheet to be used has to be changed, if the sheet feeding tray storing the sheet of desired kind does not exist, a sheet tray storing other kind of the sheet is used. When this occurs, it can be considered to store the sheet of the desired kind in the sheet feeding tray after removing the sheet of the other kind already stored in the sheet feeding tray. However, the sheet tends to be damaged when the sheet once stored in the sheet feeding tray is removed from the tray thereof and the operation is laboring. Thus, the sheets of desired kind are added and used by stacking onto the sheets already stored. Also there is a case that the same kind of sheet is added early when the amount of the remaining sheet in the sheet feeding tray becomes small.

As above, in case the sheet is added to one sheet feeding tray, the sheets originally stored in the sheet feeding tray and the added sheets are mixed in outputs unintentionally and there is possibility that the output become different from the desired output.

The present invention is realized with the above background and to provide an image forming apparatus having one aspect to prevent occurrence of the problems that output quality is deteriorated due to unintended mixing of different sheets in output, in case the sheet feeding tray is replenished with replenishment sheets.

Therefore, an image forming apparatus of the present invention is provided with: a sheet feeding tray to store sheets for image forming a sheet feeding section to feed the sheets form the sheet feeding tray so as to supply the sheet for the image forming, and a control section to respectively administer remaining sheets stored in the sheet feeding tray in advance and replenishment sheets replenished when the sheet feeding tray is replenished with the replenishment sheets in a state where the remaining sheets are stored in the sheet feeding tray.

Besides the image forming apparatus having the sheet feeding tray in the image forming apparatus main body, that includes a control section and so forth, there can be an image forming apparatus of the above configuration which is configured by connecting a sheet feeding apparatus having the sheet trays with the image forming apparatus main body. Further, an image forming system in which a post-processing apparatus is connected with the image forming apparatus can be provided.

DETAILED DESCRIPTION OF PREFERRED EMBODIMENT

An image forming apparatus of an embodiment of the present invention will be described as follow.

Figure 1:
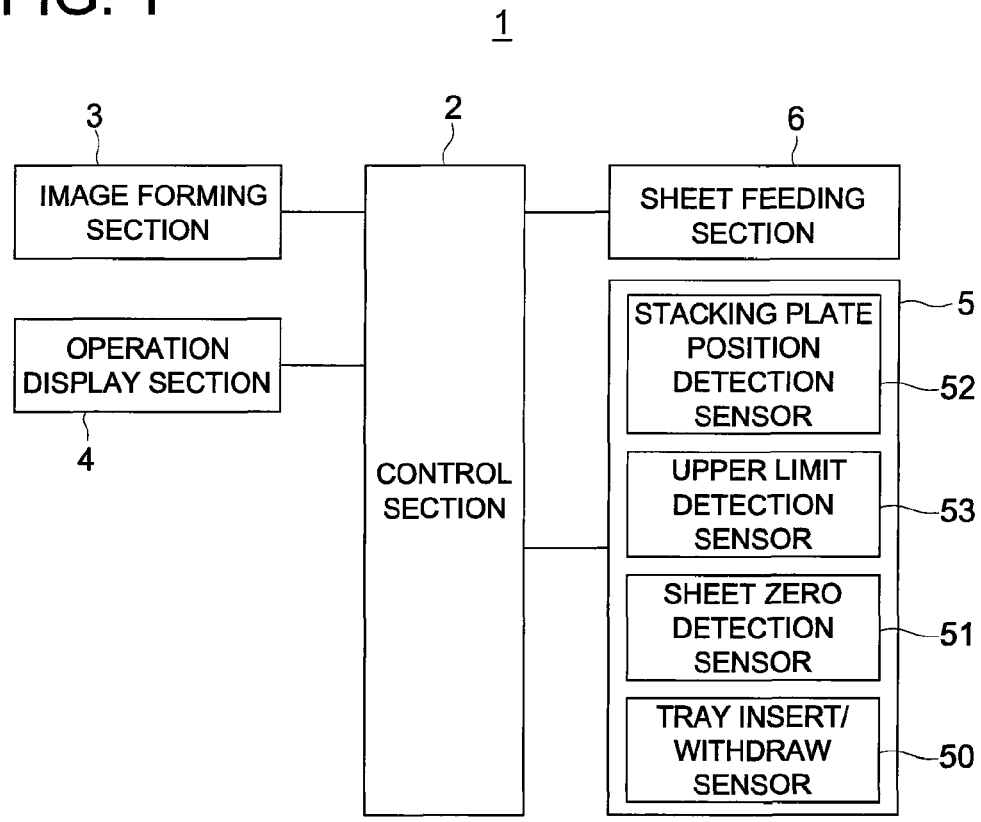
FIG. 1 is a functional block diagram of an image forming apparatus of an embodiment of the present invention.

FIG. 1 is a functional block diagram of an image forming apparatus of the present embodiment to be described as follow.

An image forming apparatus 1 is provided with a control section 2 to control the entire image forming apparatus. The control section 2 includes an unillustrated memory section.

The control section 2 can be configured with a CPU and a program to operate the CPU thereof. The control section 2 can further include a ROM to store the program, a RAM to be a work area in which administration data is temporally stored and a nonvolatile memory to store data such as setting data, process data and information and an amount of sheets in the sheet tray. To the control section 2, an image forming section 3 is connected to be controlled and the image forming section 3 is provided with an unillustrated photoconductive drum, a charging device, an exposing device, a developing device and a fixing device. In the image forming section capable of color printing, the photoconductive drums, the charging devices, the exposing devices and the developing devices are provided respectively for yellow, magenta, cyan and black colors. Also to the control section 2, an operation display section 4 configured with a touch panel is connected so as to be controlled wherein the operation display section 4 displays appropriate indications and an operator can perform input operation. Namely, the operation display section 4 serves as an operation section and a display section. Incidentally, the operation section and the display section can be provided separately in the present invention.

Figure 2:
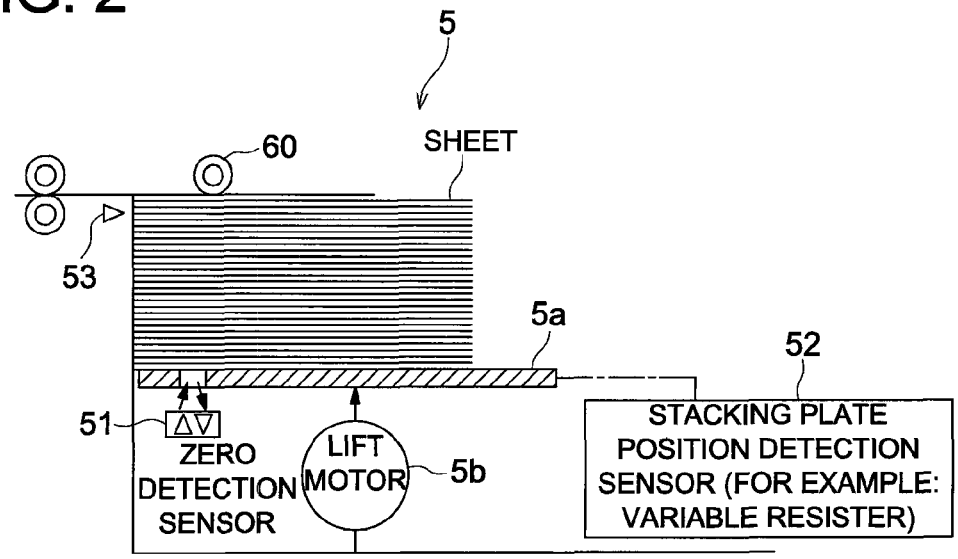
FIG. 2 is a schematic view showing a sheet feeding tray of an image forming apparatus of an embodiment of the present invention.

To the control section 2, various kinds of sensors provided in the sheet feeding tray 5 shown by FIG. 2 are connected so as to be controlled, and a detection result of each sensor is sent to the control section 2. A tray insert/withdraw sensor 50 to detect inserting and withdrawing of the sheet feeding tray 5 with respect to the image forming apparatus main body can be configured with an optical sensor and so forth. A zero sheet detection sensor 51 to detect zero sheets stacked in the sheet stack plate 5*a* of the sheet feeding tray can be configured with a reflection type or a transmitting type optical sensor. In the present embodiment, it is configured with a reflection type optical sensor. The aforesaid sheet stack plate 5*a* can be hoisted through a lift motor 5*b* controlled by the control section 2 and a stack plate position sensor 52 to detect a hoisting position of the sheet stack plate 5*a* is provided thereon. The stack plate position detection sensor 52 is configured with a variable resister which is operated by hoisting the sheet stack plate 5*a*. At the sheet feeding tray 5, an upper limit sensor 53 is provided to detect an upper most surface of the sheets stacked on the aforesaid sheet stack plate 5*a*. When the sheet stack plate 5*a* on which the sheets are stacked is hoisted by the lift motor 5*b*, the upper surface of the sheet reached at a sheet feeding position is detected. Further, to the control section 2, a sheet feeding section 6 including a sheet feeding roller 60 shown by FIG. 2 is connected so that the sheet is brought out from the sheet feeding tray 5 and fed to the image forming section 3.

Next, a control procedure when individual administration is conducted by replenishing the sheet in the aforesaid image forming apparatus 1 will be described based on the flow chart in FIG. 3. In the control section 2, when a previous job is completed, (step s1), whether or not a next job is subject to a replenishing mode (step s2) is judged.

The replenishing mode means a mode in which remaining sheets stored in the sheet feeding tray 5 in advance and the replenishment sheet replenished on the remaining sheets are administered respectively when detecting the sheet feeding tray 5 is replenished with replenishment sheets in a state where the remaining sheets are store in sheet feeding tray 5. The replenishing mode can be set as an initial setting of the image forming apparatus 1 or can be set through the operation display section 4 by the operator after the image forming apparatus 1 operates. In case that the setting is possible at the operation display section 4, the control section 2 displays a setting input screen of the job on the operation display section 4 so as to enable the replenishing mode to be selected on the screen. The replenishing mode can be applied to all jobs and one or more than two jobs.

In an ordinary mode which is not the replenishing mode, even in a case that the replenishment sheets are replenished in the sheet tray 5 in which the sheets are remaining, the remaining sheets and the replenishment sheets are not administered individually, but administered collectively. In the above case, the sheets replenished are deemed to be an increase of the remaining sheets. The replenishing mode can be changed to the ordinary mode. The change can be conducted through setting input at the operation display section 4 by the operator, and the ordinary mode can be changed to the replenishing mode. Also, as the present embodiment, the image forming apparatus can be provided with only a function equivalent to the replenishing mode which is not provided with both the ordinary mode and the replenishing mode.

Next, in case that the replenishing mode is not selected in the above process (step s2: No), the control process of the replenishing mode is terminated.

In case a next job is subject to the replenishing (step s2: Yes), the stack plate position sensor 52 detects a position of the sheet stack plate 5*a*, and the detected result is stored in the memory section of the control section 2. When this occurs, the sheet stack plate 5*a* ascends by a lift motor 5*b* up to a position where the upper surface of the sheet is detected by the upper limit detection sensor 53. Next, the tray insert/withdraw sensor 50 detects inserting and withdrawing of the sheet feeding tray 5 (step s4) then when inserting and withdrawing of the sheet feeding tray 5 is detected (step s4: Yes), whether or not the remaining sheet amount is increased is judged (step s5).

When the sheet feeding tray 5 is withdrawn from the image forming apparatus main body, the sheet stack plate 5*a* automatically descents through the lift motor 5*b* and replenishing of sheet becomes possible. When the sheet feeding tray 5 is inserted into the image forming apparatus main body again, the sheet stack plate 5*a* ascends through the lift motor 5*b* then the upper limit sensor 51 detects the upper most surface of the sheets stacked in the sheet stack plate 5*a* so as to stop the lift motor 5*b*. When this occurs, a stop position of the sheet stack plate 5*a* has been detected by the sheet stack plate position sensor 52, and the control section 2 reads a detection result before the sheet feeding tray 5 has been withdrawn and inserted from the memory section and compares it with the stop position after the sheet feeding tray 5 has been withdrawn and inserted. If the replenishing of the sheets is not carried out, the stopping position of the sheet stack plate does not change, whereby it is judged that the remaining amount of the sheets has not increased. On the other hand, if replenishing has been carried out, the stop position of the sheet stack plate 5*a* is lowered by a thickness of the replenishment sheets, and by comparing the detection results before and after the inserting/withdrawing of the sheet feeding tray 5, it is judged that the remaining amount of the sheets has increased.

In case the remaining amount of the sheets is judged not to be increased (step s5: No.), a confirmation massage to remind setting of the replenishment sheets and an indication to cancel the replenishing mode are displayed on the operation display section 4 (step s8) and the process is terminated once. On the other hand, In case the remaining amount of the sheets is judged to be increased (step s5: Yes.), the control section 2 judges that the sheets are replenished, namely the replenishing is detected, and sets the stop position of the sheet stack plate 5*a* memorized before replenishment as a remaining amount threshold with respect to the replenishment sheets (step s6). In the above example, the inserting/withdrawing sensor 50, and the stack plate position detection sensor 52 serve as a replenishing detection section of the present embodiment. As above, in the sheet feeding tray 5, by providing a remaining sheet amount detection section which can perform remaining amount detection of the remaining sheet amount in the tray separately from the replenished sheets, the remaining sheet amounts in individual administration and a replenishing position indicating a border between the remaining sheets and the replenishment sheets can be known. Incidentally, as the remaining sheet amount, number of the sheets, a thickness and a weight can be cited. The sheet remaining amount detection section can be any detector to detect in accordance with the above detection items. An optical sensor and a weight sensor having an appropriate configuration are selected without being limited to specific sensors in the present embodiment.

After detecting replenishment as above, the control section 2 identifies the replenishing position based on information of the sheet stack plate 5*a* acquired in the above process and calculates the remaining amount of the replenishment sheets based on the difference between the stop position of the sheet stack plate 5*a* and the replenishing position. On the basis of the calculation result, the remaining amount of the sheet stored in the sheet tray 5 before replenishment and the remaining sheet amount of the replenishment sheet having been replenished are distinguished and displayed on the operation display section 4 respectively (step s7). Also, incase the amount of remaining sheet and the amount of remaining replenishment sheet change in accordance with execution of JOB, the control section 2 administers to change the remaining amounts and displays them on the operation display section 4.

In the above exemplary process, the replenishing position is identified based on the stop position of the above sheet stack plate 5*a* and the remaining amount of the replenishment sheet can be calculated based on the difference between the stop position of the sheet stack plate 5*a* and the replenishing position. When the difference becomes 0, the remaining amount of the replenishment sheet is 0 which means the replenishment sheet has run out. In the next example, by inputting the number of the sheets to be replenished directly, accurate sheet remaining number can be known. The flow chart in FIG. 4 will be described as follow.

The control section 2 judges whether or not the next job is subject to the replenishing mode (step s11), after the former JOB is completed (step s10). The replenishing mode is set as a default or is set by the operator when inputting settings of the JOB by selecting the replenishing mode. In case the replenishing mode is not selected (step s11: No), the control process of the replenishing mode is terminated. In case the next JOB is subject to the replenishing mode (step s11: Yes) the control section 2 controls the operation display section 4 to display a replenishment sheets number input screen which is shown in FIG. 5.

Figure 5:
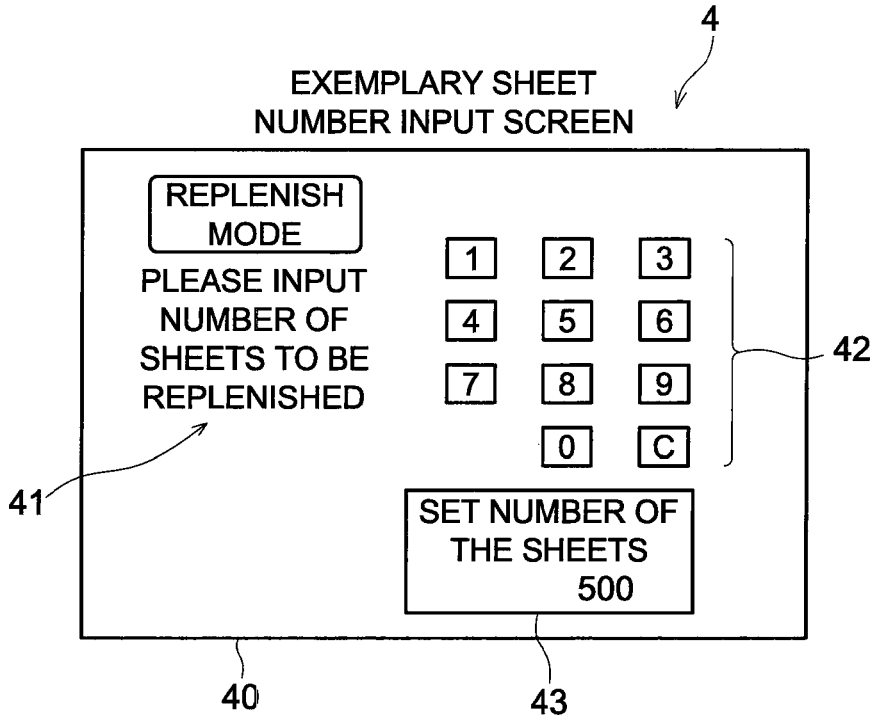
FIG. 5 is a diagram showing an input screen of replenishing number at time of replenishing position judgment.

In the replenishment sheets number input screen 40 of FIG. 5, it is displayed that the JOB is subject to the replenishing mode and a display column 41 to request sheet number input is displayed, then an input section 42 configured with ten keys and a clear key to enable input the sheet number is displayed to be able to operate input and then a sheet number display column 43 to display input number of the sheets is displayed. By touching each numerical button of the input section 42, input replenishment sheet numbers are inputted and by touching the sheet number display column 43, input of the number of the sheets is completed. In the control section 2, the sheet number is stored in the memory section (step s12).

Next, the tray inserting/withdrawing sensor detects insert/withdrawing of the tray (step s13). When inserting/withdrawing of the tray is detected, (step s13: Yes), whether or not the sheet remaining amount is increased is judged (step s14).

As the forgoing, increase of the sheet remaining amount is judged by judging positional change of the sheet stack plate 5*a*. When the remaining amount of the sheet is judged not to be increased in the above judgment (step s14: No), a confirmation message to request setting of replenishment sheet or cancellation of the replenishing mode is displayed on the operation display section 4 (step s17), then the process is terminated once. On the other hand, if remaining sheet amount is judged to be increased (step s14: Yes), the control section 2 judges that the replenishing of sheet has been carried out, namely replenishing is detected, and set the replenishment sheet number stored before replenishing as a sheet remaining amount threshold (step s15). In the above example, the tray inserting/withdrawing sensor 50 and the stack plate position detection sensor 52 serve as the replenishing detection section of the present embodiment.

The control section 2 identifies the replenishing position based on the input of the replenishment sheet number, and calculates the remaining sheet amount based on the difference between the replenishment sheet number and number of replenishment sheets havening been used Based on the above calculation result, the control section 2 distinguishes and display the amount of the remaining sheets stored in the sheet feeding tray before replenishing from the amount of the remaining replenishment sheets on the operation display section 4 respectively (step s16). The number of replenishment sheets having been used can be administered in the control section 2 to control the sheet feeding section 6 which feeds the sheet. When the number of replenishment sheets having been used reaches at the number of the replenishment sheets, the remaining amount of the replenishment sheets becomes 0 which tells that the replenishment sheets have run out.

In each of the above examples, a thickness of the sheets, the remaining sheets amount in the sheet number and the replenishing position can be known. Besides the forgoing, the remaining sheet amount can be known by the weight of the sheet, and the method to know the remaining sheet amount is not limited to the above examples.

Figure 3:
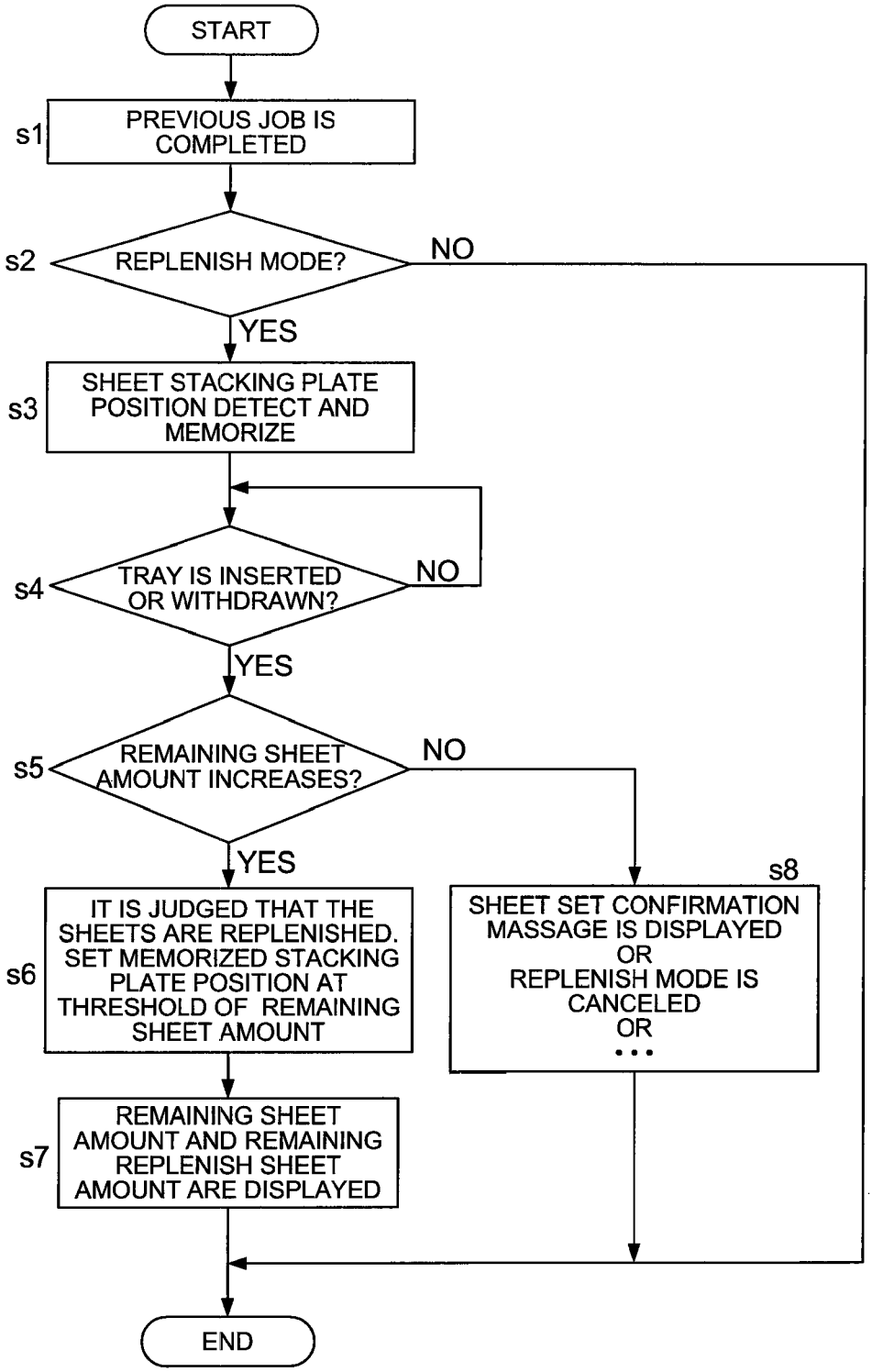
FIG. 3 is a flow chart of an image forming apparatus of an embodiment of the present invention showing an exemplary judging process of replenishing position when replenishment is detected.
Figure 4:
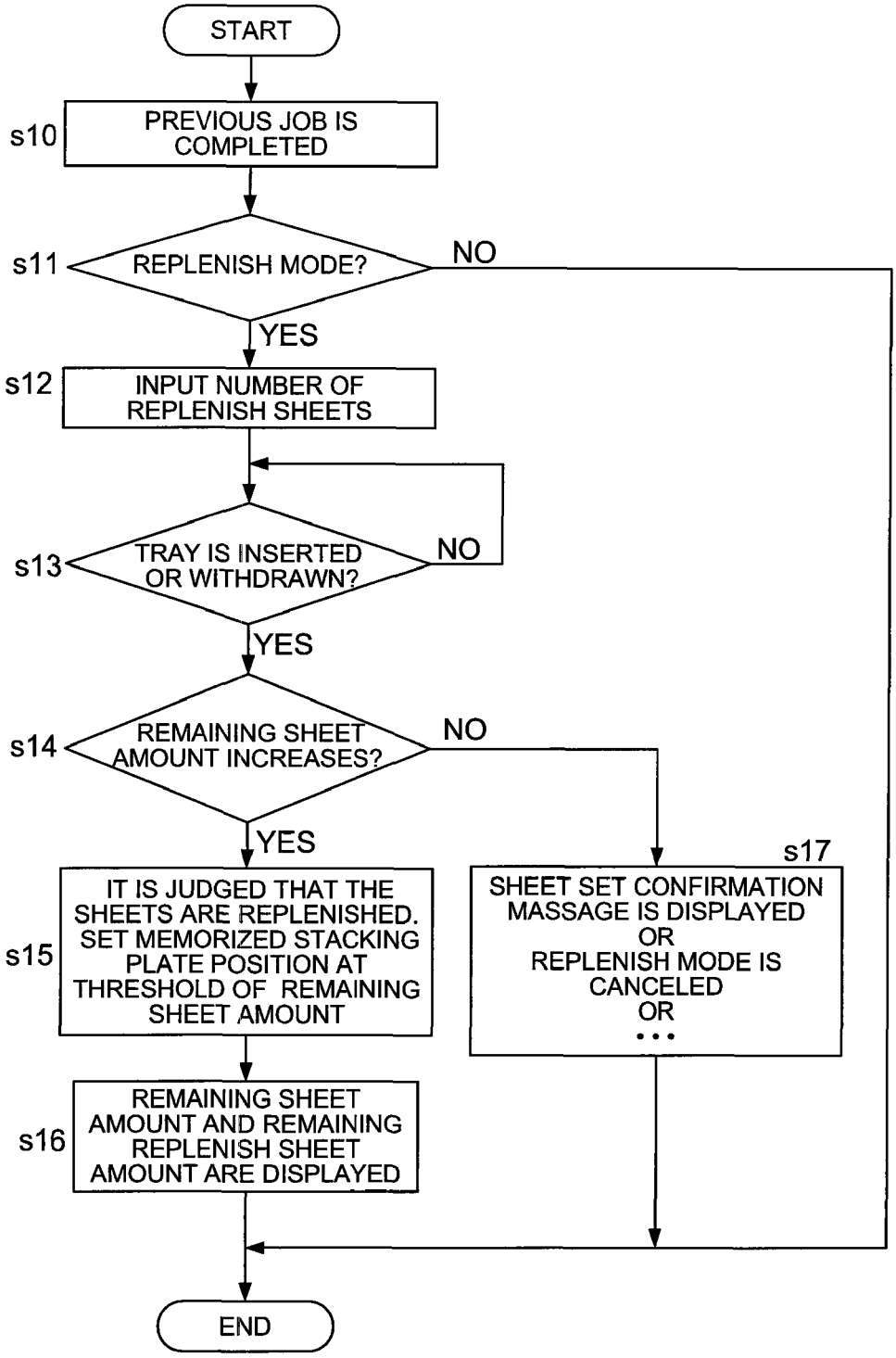
FIG. 4 is a flow chart showing another exemplary judging process of replenishing position when replenishment is detected.

Incidentally, in the exemplary control shown in FIG. 3 and FIG. 4, detection of replenishing of the sheet is detected by detecting the position of the sheet stack plate and by judging inserting/withdrawing of the sheet tray. Besides the foregoing, for example, sheet replenishing can be identified by detecting difference of colors or gloss of the sheets stored in the sheet tray through a color sensor or a gloss sensor. The control section 2 identifies replenishment. For example, in advance, the color sensor and the gloss sensor detect the colors and gloss of the remaining sheets in the sheet feeding tray and the sheets subject to replenishing, then after the sheet feeding tray is inserted and withdrawn if the different color or different gloss of a sheet is detected, replenishing of the sheet having different color or different gloss can be confirmed. Inserting and withdrawing of the sheet feeding tray can be detected through the inserting/withdrawing sensor 50 provided at the sheet feeding tray or the image forming apparatus main body side. Thus, the color sensor, the gloss sensor and the sheet feeding tray inserting/withdrawing sensor 50 serve as a replenishing detection section of the present embodiment. Also, in case detection of the replenishing is carried out by the color sensor and the gloss sensor, by utilizing that the colors and gloss before and after the replenishing are different, replenishing has not been carried out can be detected and confirmed. The control section 2 identifies replenishment. Also, detection of replenishing can be performed by a sensor to detect a bookmark or a sheet indicating replenishing placed at the replenishing position in the sheet feeding tray.

Figure 6A:
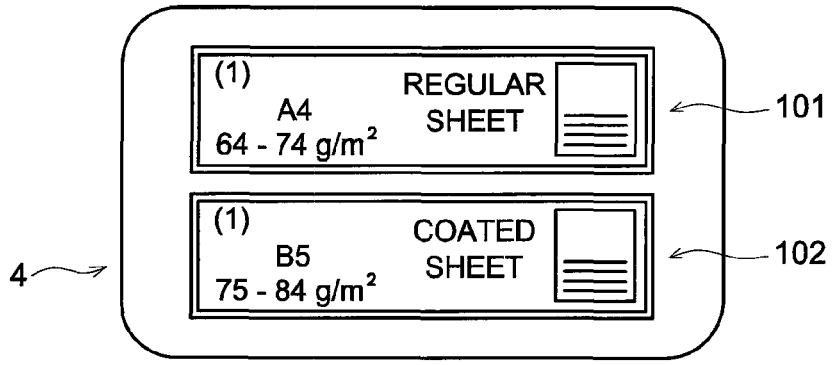
FIG. 6*a* is a diagram showing a conventional operation display section indicating sheet information.

The control section 2 enables input of the sheet information of the replenishment sheet. Conventionally, input of the sheet information of the sheet stored in the sheet feeding tray has been possible. A conventional example showing the aforesaid information is shown in FIG. 6*a*. In FIG. 6*a*, sheet information 101 of the first sheet feeding tray and sheet information 102 of the second sheet feeding tray are indicated. It is indicated that a sheet of A4 size normal paper having a basis weight of 64 to 74 g/m$^2$ is stored in the first sheet feeding tray, and a remaining sheet amount is further indicated in a graph. Also, it is indicated that a sheet of B5 size coat paper having a basis weight of 75 to 84 g/m$^2$ is stored in the second sheet feeding tray and a remaining sheet amount is further indicated in a graph. As above, conventionally, sheet information of one kind of the sheet can be administered with respect to one sheet feeding tray.

Figure 6B:
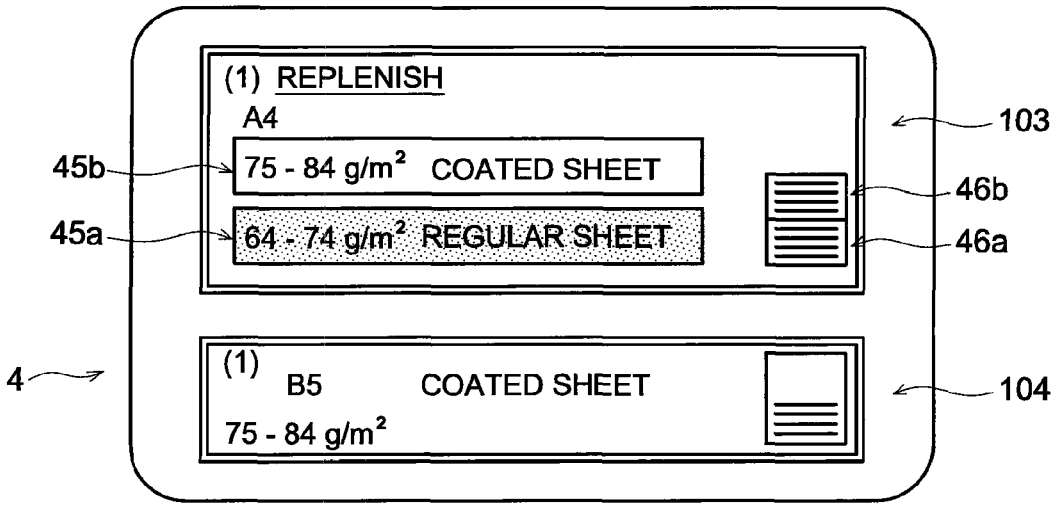
FIG. 6*b* is a diagram showing an operation display section of a present embodiment indicating sheet information.

On the other hand, in the present embodiment, as FIG. 6*b* shows, sheet information 103 of the first sheet feeding tray and sheet information 104 of the second sheet feeding tray are indicated on the operation display section 4. In the present embodiment, in case the same kinds of sheets are stored in the same sheet feeding tray, the sheet information of one kind of the sheet can be displayed in the same manner as above. Further, in case the sheets have been replenished, sheet information indications 45*a* and 45*b* and remaining sheet amount indications 46*a* and 46*b* are displayed respectively for the remaining sheets and for the replenishment sheets with respect to one sheet feeding tray. Namely, in the first sheet feeding tray which has been replenished with sheets, the sheet information indication 45*a* showing that the sheets of A4 size normal paper having the basis weight of 64 to 74 g/m$^2$ are stored is displayed as the sheet information of the sheet subject to replenishing, and the sheet information indication 46*a* of the remaining sheet amount of the sheet thereof is graphed. Further in the first sheet feeding tray, the indication 45*b* showing that the replenishment sheets of A4 size coated paper having the basis weight of 75 to 84 g/m$^2$ are stored is displayed and the indication 46*b* of the remaining sheet amount of the sheet thereof is graphed. Whereby, a storing state of the sheet feeding trays having been replenished can be observed immediately and readily through the operation display section 4.

The sheet information for replenishment sheets is administered by the control section 2 and stored in a memory section provided in the control section 2. The sheet information is usually inputted and set by the operator through the operation display section 4. In the control section 2, when replenishing is detected in the replenishing mode, input of the sheet information of the replenishment sheet through the operation display section 4 is enabled. Besides the forgoing, the sheet information can be acquired by sensors appropriately and method to acquire is not specified in the present embodiment. It is preferred that the above sheet information is displayed on the operation display section 4 to be visible for the operator, and each remaining sheet amount is also displayed on the operation display section along with the sheet information.

Also, as individual administration in the above replenishment, there can be administration where image forming conditions and sheet feeding conditions can be set respectively. Whereby, sheets can be fed under appropriate conditions which are suitable for the each kind of the sheet. The above conditions can be set by the control section with reference to setting data stored in the memory section in advance while being correlated to the sheet information. Also, the above conditions can be inputted and set by the operator through the operation display section 4, and set without being correlated to the sheet information.

Figure 7:
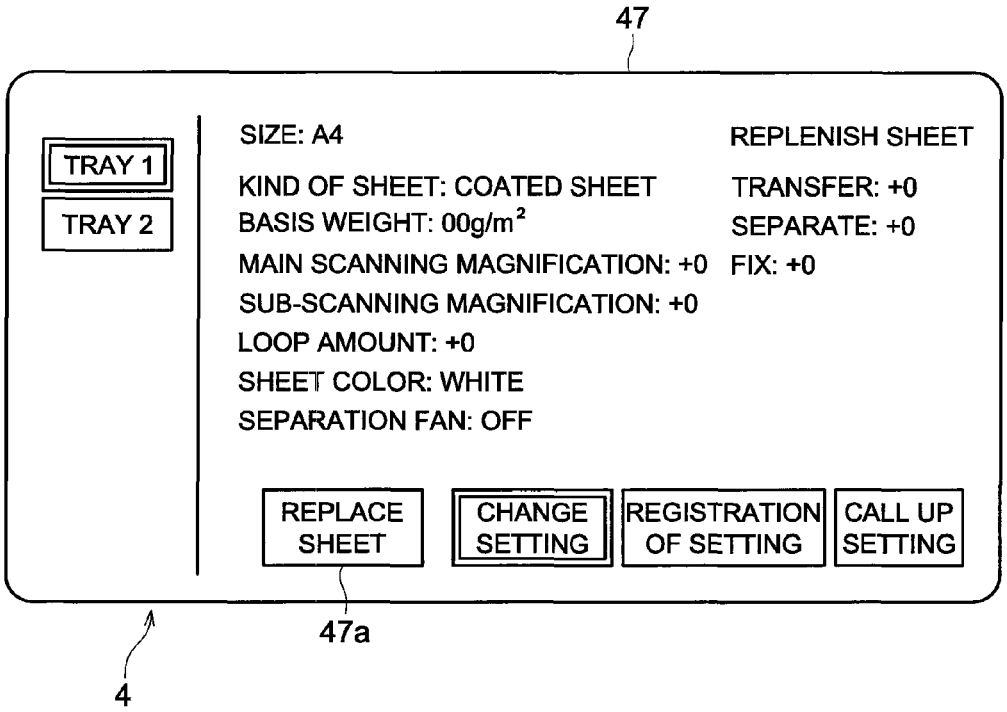
FIG. 7 is a diagram showing a setting screen of sheet feeding conditions and image forming conditions.

FIG. 7 is an exemplary display of a condition setting screen with respect to FIG. 6*b*. A condition setting screen 47 in which the image forming conditions of the replenishment sheet and sheet feeding conditions in the first sheet feeding tray are set is displayed on the operation display section 4. In the condition setting screen 47, setting is possible for each item of sheet information in each sheet feeding tray. In the above example, condition setting is possible respectively with respect to two items of sheet information in the first sheet feeding tray. In the condition setting screen 47 shown in the figure, setting of an image forming magnification ratio and conditions of transfer, separation and fixing are possible as well as displaying sheet conditions of the replenishment sheet. Further, setting of an amount of loop at a registration roller, and on/off setting of a separation fan in the sheet feeding tray is possible. Incidentally, the items capable of being set are not limited in the present embodiment, and as the above image forming conditions, an image forming magnification ratio, an exposing condition, a developing condition, a fixing condition, a separation condition, a image forming speed, distinction of color or monochrome and a fixing temperature can be cited. Also, as the sheet feeding conditions, a distance between the sheets, a conveyance linier speed, on/off of separation fan and the loop amount at the registration roller can be cited. Also, image forming conditions, and sheet feeding conditions to be able to set in the image forming apparatus can be cited. Incidentally, setting indications for the remaining sheet and replenishment sheet can be altered by a sheet changeover button 47*a*.

Figure 8:
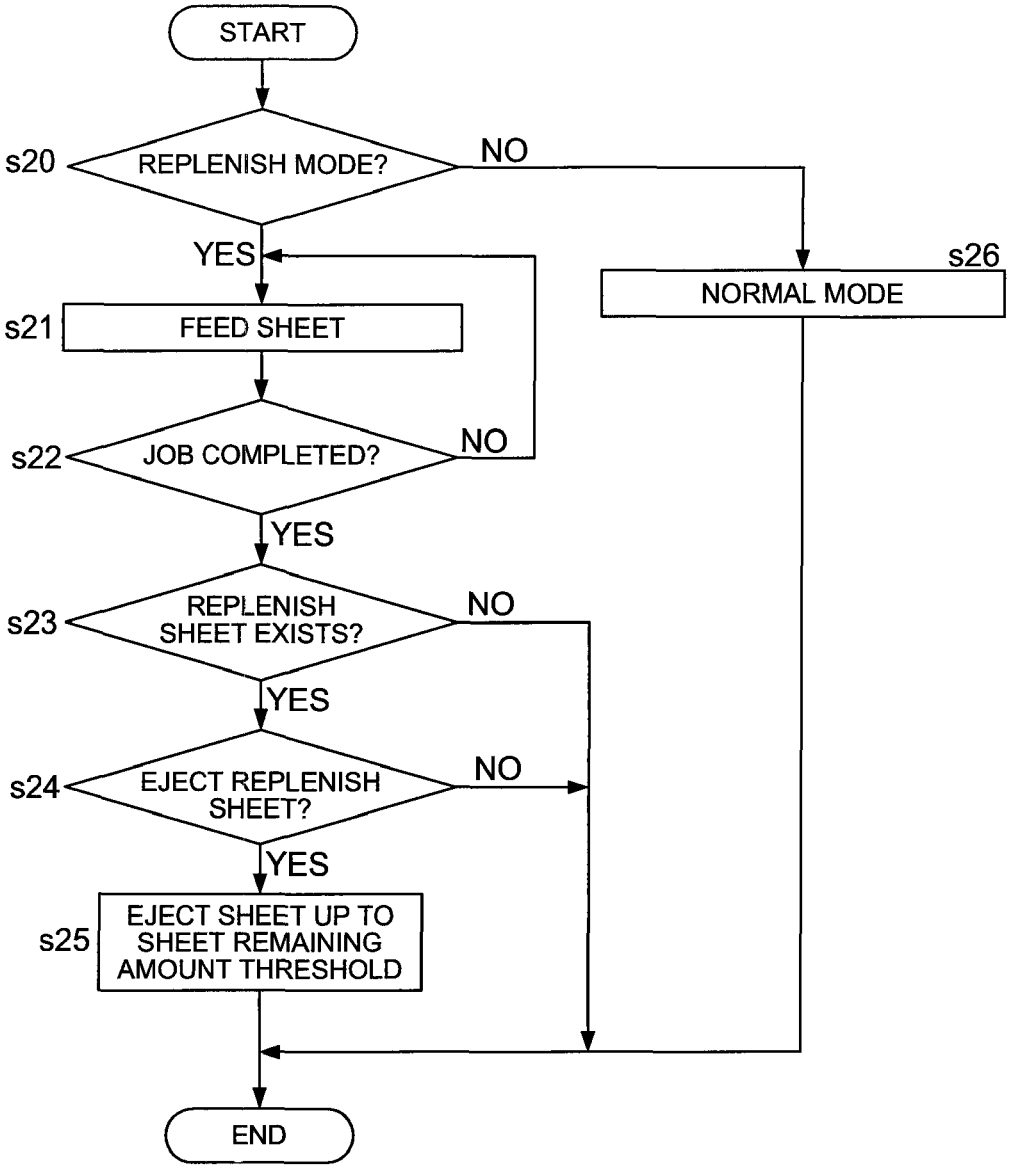
FIG. 8 is a flow chart showing an exemplary sheet feeding control procedure in case replenishment is detected and administered separately.

Next, an exemplary control process of the sheet feeding in the replenishing mode will be described. First, an example wherein a JOB can be executed within number of replenishment sheets will be described based on a flow chart in FIG. 8. The control section 2 judges whether or not the JOB is subject to the replenishing mode (step s20). In case the replenishing mode is not selected (step s20: No), the sheets are fed in the normal mode (step s26). In case the JOB is subject to the replenishing mode (step s20: Yes), sheet feeding is continued until the JOB is completed (step s21, step s22: No). When the JOB is completed (step s22: Yes), whether or not the replenishment sheets are remaining in the sheet feeding tray is judged (step s23). The above judgment can be conducted out by checking whether or not the remaining amount of the replenishment sheets is 0.

In case the replenishment sheets are not remaining (step s73: No), the process is terminated. In case the replenishment sheets are remaining, whether or not the remaining replenishment sheets are ejected is judged (step s24). Whether or not sheet ejection is carried out can be selected by the operator by displaying a request for setting on the operation display section 4. Or by setting and storing the processing method in the memory section in advance, then when the JOB is terminated, the control section 2 may conduct the process in accordance with the set items with reference to setting items.

In case the ejection of the replenishment sheets is not selected (step s24: No.), the process is terminated. In case ejection of the replenishment sheets is selected (step s24: Yes), the replenished sheets are ejected up to the remaining sheet amount threshold value from the sheet feeding tray 5 (step s25). The remaining sheet amount threshold value can be obtained from the aforesaid position of the sheet stack plate 5*a* or the number of sheets inputted by the operator. Whereby, when the JOB which requires the replenishment sheets is terminated, the remaining sheets can be ejected from the sheet feeding tray 5 readily. By ejecting the remaining replenishment sheets, mixing of the sheets is obviated in a latter JOB and labor to take out the replenishment sheets can be saved.

Figure 9:
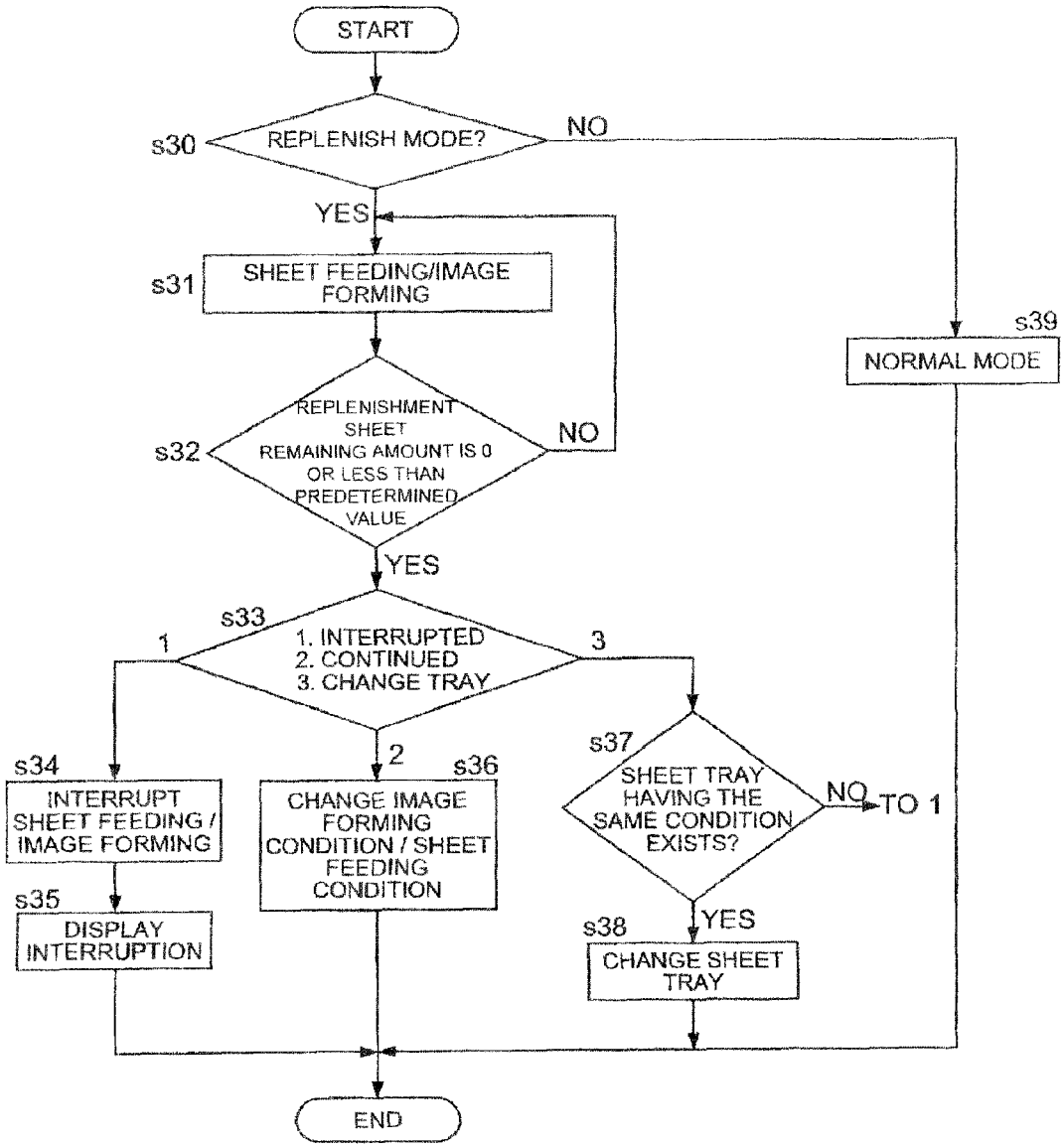
FIG. 9 is a flow chart showing another exemplary sheet feeding control procedure.

In the foregoing, while the example wherein the JOB can be executed within number of replenishment sheets has been described, an example wherein a JOB can not be executed within number of replenishment sheets will be described with reference to a flow chart in FIG. 9. The control section 2 judges whether or not the JOB is subject to the replenishing mode (step s30). In case the replenishing mode is not selected (step s30: No), sheet feeding and image forming is carried out in the normal mode (step s39). In case the JOB is subject to the replenishing mode, (step s30: Yes), sheet feeding and image forming are continued until the remaining amount of the replenishment sheets in the sheet feeding tray 5 becomes 0 or less that a predetermined amount (step s31, step s32: No). The above predetermined amount determined in advance is stored in the memory section. The control section 2 refers and uses the predetermined amount for the above judgment. Incidentally, in sheet feeding and image forming, the image forming conditions and the sheet feeding conditions are selected based on the sheet information of the replenishment sheet. In the control section 2, the conditions can be set based on the sheet conditions or the conditions can be set by the operator in accordance with the sheet conditions. While feeding the sheets, when the remaining amount of the replenished sheets in the sheet feeding tray 5 becomes 0 or less than the predetermined amount (step s32: Yes), the flow transfers to a procedure of a process selection (step s33). Incidentally, the above predetermined amount can be set appropriately, for example, the control section 2 stores the predetermined amount in the memory section and refers the predetermined amount for the above judgment. Also, it can be changed on the operation display section 4.

Figure 10:
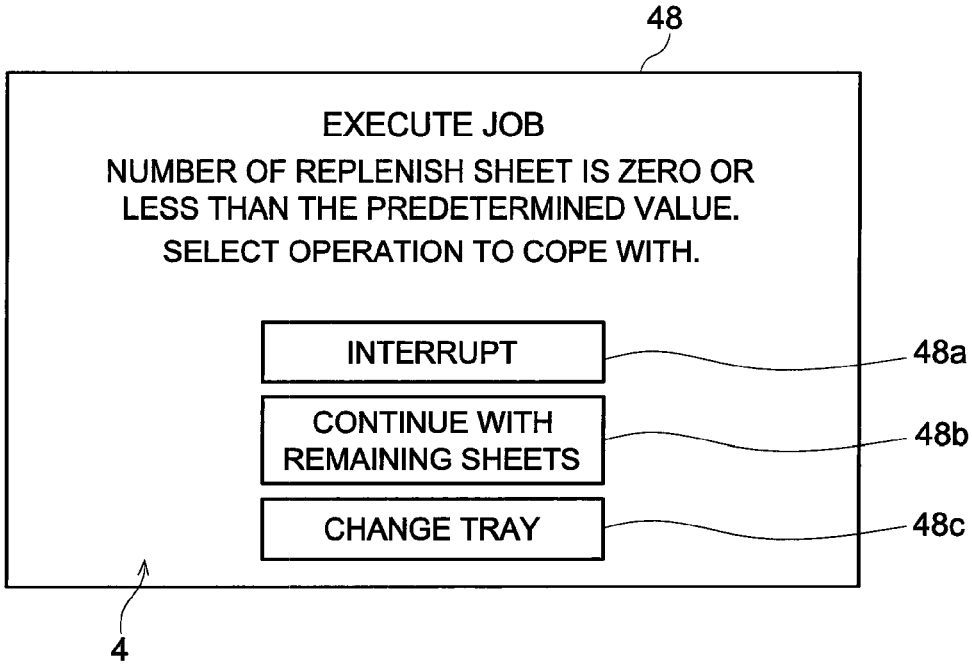
FIG. 10 is a screen to a select processing method when replenishment sheets run out in case replenishment is detected and administered separately.

As FIG. 10 shows, the above process selection displays a selection screen 48 on the operation display section 4 so that the operator can be determined. In the selection screen 48, an abort selection button 48*a* to abort image forming process, a continuation selection button 48*b* to continue image forming process using the remaining sheets, and a tray changeover button 48*c* to change the sheet feeding tray storing the sheets having the same conditions in order to continue the image forming process are displayed so as to enable inputs. The selection screen 48 can be included in items which can be set as default setting or can be selectable when the flow transfers to the replenishing mode, or the number of the remaining replenished sheets becomes 0 or less than the predetermined amount. Meanwhile, in case the replenishment sheets run out or become less than the predetermined amount, while executing the JOB, the operator can set what process to carry out on the operation display section 4 and store the setting items in the memory section in advance. In the above case, when the replenishment sheets run out or become less than the predetermined mount, the control section 4 refers the memory section and the process can be automatically determined. Also, the image forming apparatus can be set to carry out any one of process without having the above choices.

In case abort process is set as a processing method, the sheet feeding and image forming process are aborted (step s34) and abortion due to running out of replenishment sheets is displayed on the operation display section 4 (step s35). Further, in the operation display section 4, selection of cancelling the process, selection of continuation using remaining sheets by returning to step s33 and selection of changing the sheet feeding tray 5 can be possible. Also, the process can be restarted by replenishing the replenishment sheets. When the replenished sheets run out or become less than the predetermined amount, by aborting the JOB being executed, production of unintentional outputs where different sheets are mixed can be obviated.

The continuation process using the remaining sheets is selected as the processing method, in case the remaining amount of the replenished sheets is 0. When the continuation process is selected, the conditions are changed to the sheet feeding conditions and the image forming conditions which have been set to correspond to the remaining sheets (step s36) and sheet feeding and image forming are continued. By changing the conditions to the image fanning conditions and the sheet feeding conditions appropriate for the remaining sheets, image forming can be continued under the conditions appropriate for the sheets, and productivity can be maintained at a high level by continuing execution of the JOB.

Also, as another processing method, in case the sheet feeding tray changeover is selected, whether or not sheet feeding tray storing the sheet having the same conditions exists is judged (step s37). As the same conditions, the aforesaid conditions can be cited. Here, factors to judge whether or not the conditions are the same can be set appropriately. As the factors of same conditions of the sheet, a sheet color, a sheet size, a kind of sheet and a basis weight can be cited. Further, the same kind includes factors such as the same manufacturer, the same storage term, the same direction of curling. The items of the same conditions can be set in each image forming apparatus, and the factors defining to be the same condition can be changed with respect to each JOB and each user. In addition the factors defining to be the same condition can be set appropriately by the operator through the operation display section 4. The factors to determine to be the same conditions are not limited to the specific factors in the present embodiment. In case the sheet feeding tray storing the sheets having the same conditions does not exist (step s37: No), returning to step s33, the buttons except the tray changeover button 48*c* are made selectable or a predetermined process is executed. In the example a procedure to shift to step s34 and execute the abort process is indicated. In case the tray storing sheets having the same conditions exists (step s37: Yes), changing to the sheet feeding tray thereof, sheet feeding and image forming are continued (step s38). As above, by changing to the other sheet feeding try in which the sheets having the same conditions is stored, execution of the JOB can be continued. Whereby, by continuing the JOB without interruption, the productivity can be maintained. In case of changing trays as above, an indication to inform the circumstances of change of the sheet feeding tray can be displayed on the operation display section 4 and in case of abort, an indication to inform abort is displayed. Incidentally, there is an apparatus provided with an automatic sheet feeding tray change function which changes a sheet feeding tray to another sheet feeding tray storing sheets having the same conditions when the sheets in the sheet feeding tray run out or become less than the predetermined amount in the normal mode as well, wherein as the sheet feeding tray to substitute for the former sheet feeding tray, sheet feeding trays replenished with sheets different from the sheets in the former sheet feeding tray can be omitted. Whereby, in the normal mode it can be obviated that different sheets are mixed and outputted without fail. With each selection procedure in the forgoing, the processes can be executed appropriately in the replenishing mode.

As above, the embodiments related to the present invention have been described without the present invention being limited to the embodiments and changes and variations may be made without departing from the scope of the appended claims.

As described above, according to the present embodiments, it can be obviated that the remaining sheets and the replenishment sheets are mixed and outputted which the user does not intend.

What is claimed is:

1. An image forming apparatus, comprising:

a sheet feeding tray to store sheets for image forming;

a sheet feeding section to feed the sheets from the sheet feeding tray so as to supply the sheets for the image forming, and a control section to respectively administer (i) remaining sheets stored in the sheet feeding tray in advance and (ii) replenishment sheets having been replenished in the sheet feeding tray when the sheet feeding tray is replenished with the replenishment sheets in a state in which the remaining sheets are stored in the sheet feeding tray;

wherein after a JOB to feed the replenishment sheets from the sheet feeding tray is completed, in case the replenishment sheets are remaining in the sheet feeding tray, the control section controls the sheet feeding section to eject the remaining replenishment sheets from the sheet feeding tray.

2. The image forming apparatus of claim 1, wherein the control section respectively administers sheet information of the remaining sheets and sheet information of the replenishment sheets in the sheet feeding tray.

3. The image forming apparatus of claim 1, wherein the control section administers a remaining amount of the remaining sheets and a remaining amount of the replenishment sheets in the sheet feeding tray.

4. The image forming apparatus of claim 1, wherein the control section administers a replenishing position which shows a border between the remaining sheets and the replenishment sheets in the sheet feeding tray.

5. The image forming apparatus of claim 1, further comprising a replenishing detection section to detect that the sheet feeding tray is replenished.

6. The image forming apparatus of claim 5, wherein the control section receives a detection result from the replenishing detection section and conducts administration based on the detection result.

7. The image forming apparatus of claim 1, further comprising a display section controlled by the control section, wherein the control section controls the display section to display at least one of a remaining amount of the replenishment sheets and sheet information of the replenishment sheets, and at least one of a remaining amount of the remaining sheets and sheet information of the remaining sheets.

8. The image forming apparatus of claim 1, wherein the control section is configured to set at least one of an image forming condition and a sheet feeding condition for the replenishment sheets.

9. The image forming apparatus of claim 1, wherein the control section is configured to set at least one of an image forming condition and a sheet feeding condition respectively for the remaining sheets and the replenishment sheets in the sheet feeding tray.

10. The image forming apparatus of claim 1, wherein while a JOB to feed the replenishment sheets from the sheet feeding tray is in execution, when the replenishment sheets in the sheet feeding tray run out or become less than a predetermined amount, the control section aborts execution of the JOB.

11. The image forming apparatus of claim 1, wherein while a JOB to feed the replenishment sheets from the sheet feeding tray is in execution, when the replenishment sheets in the sheet feeding tray run out, the control section continues execution of the JOB by feeding the remaining sheets based on at least one of an image forming condition and a sheet feeding condition of the remaining sheets.

12. The image forming apparatus of claim 1, further comprising additional sheet feeding trays, wherein while a JOB to feed the replenishment sheets from the sheet feeding tray is in execution, when the replenishment sheets in the sheet feeding tray run out or become less than a predetermined amount, the control section changes the sheet feeding tray to one of the additional sheet feeding trays in which sheets having a same condition as the replenishment sheets are stored and continues the JOB.

13. The image forming apparatus of claim 1, wherein in an automatic sheet tray changing the control section omits a sheet feeding tray replenished with replenishment sheets different from the remaining sheets to be selected.

14. The image forming apparatus of claim 1, wherein in case replenishing of the replenishment sheets is judged to be an increase of a remaining sheet amount, the control section administers the remaining sheet and the replenishment sheet collectively.

15. The image forming apparatus of claim 1, further comprising a display section controlled by the control section, wherein the control section controls the display section to display at least one of a remaining amount of the replenishment sheets and sheet information of the replenishment sheets.

16. The image forming apparatus of claim 15, wherein the control section controls the display section to display a replenishing position in the sheet feeding tray.

17. The image forming apparatus of claim 15, wherein when the replenishment sheets in the sheet feeding tray run out or become less than a predetermined amount, the control section controls the display section to indicate a notification thereof.

18. The image forming apparatus of claim 1, further comprising an operation section controllable by the control section, wherein the control section enables the operation section to accept input of replenishing information by an operator.

19. The image forming apparatus of claim 18, wherein the control section enables the operation section to accept input of at least one of a sheet amount of the replenishment sheets and sheet information of the replenishment sheets.

20. The image forming apparatus of claim 18, wherein the control section enables the operation section to accept input of a sheet replenishing position in the sheet feeding tray.

* * * * *